US006435212B2

(12) United States Patent
Brandebusemeyer

(10) Patent No.: US 6,435,212 B2
(45) Date of Patent: Aug. 20, 2002

(54) PIVOTAL FAUCET

(75) Inventor: Heinz Brandebusemeyer, Menden (DE)

(73) Assignee: Friedrich Grohe AG & Co. KG, Hemer (DE)

( * ) Notice: Subject to any disclaimer, the term of this patent is extended or adjusted under 35 U.S.C. 154(b) by 0 days.

(21) Appl. No.: 09/823,122

(22) Filed: Mar. 30, 2001

(30) Foreign Application Priority Data

Apr. 6, 2000 (DE) ..... 100 16 977

(51) Int. Cl.[7] ..... E03C 1/04
(52) U.S. Cl. ..... 137/615; 137/801
(58) Field of Search ..... 137/615, 801

(56) References Cited

U.S. PATENT DOCUMENTS 5,301,715 A * 4/1994 Becker ..... 137/615
5,873,387 A * 2/1999 Weber et al. ..... 137/615

FOREIGN PATENT DOCUMENTS

EP 304 529 3/1989

* cited by examiner

*Primary Examiner*—Gerald A. Michalsky
(74) *Attorney, Agent, or Firm*—Herbert Dubno; Andrew Wilford

(57) ABSTRACT

A faucet assembly has a stationary base body having an outer surface formed with a passage having an outlet end opening at the outer surface. A spout sleeve fitted over the base body has an inner surface radially inwardly confronting the base-body outer surface. One of the surfaces is formed with a radially open groove, open toward the other surface, and into which the passage outlet end opens. A spout projecting radially from the sleeve has an outwardly open passage opening inward into the groove. Water is supplied to the base-body passage to flow into the groove and thence through the spout passage and out of the spout. A radially expansible brake ring has an inner surface bearing radially inward against the base body and an outer surface bearing radially outward against the sleeve.

13 Claims, 1 Drawing Sheet

Fig. 1
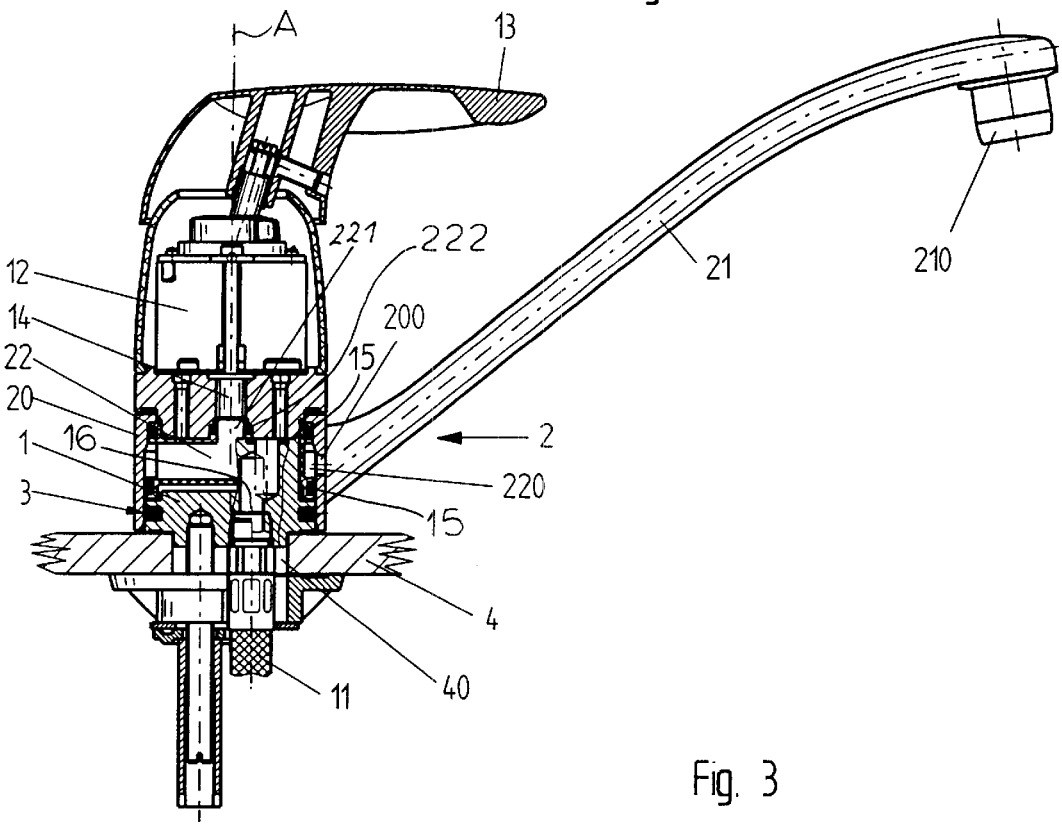
Fig. 3
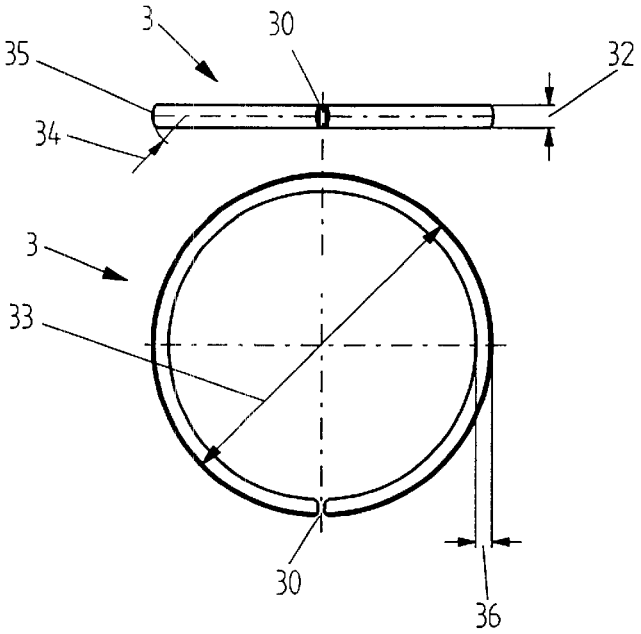
Fig. 4
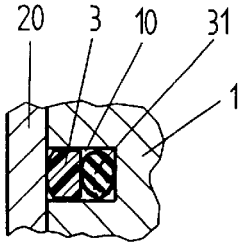
Fig. 2

PIVOTAL FAUCET

SPECIFICATION

1. Field of the Invention

The present invention relates to a faucet. More particularly this invention concerns a faucet that pivots on a base.

2. Background of the Invention

In a standard faucet assembly such as described in European patent application 0,304,529 of I. Hecht-Burgos a stationary base body has an outer surface centered on an upright axis and is formed with at least one inlet port and at least one radially open outlet port. A spout has a support sleeve that fits over the base body and either an inner surface of the sleeve or the outer base-surface sleeve is formed with a radially open groove into which the outlet port opens. A hollow arm on the sleeve forms the actual spout and opens at its inner end into this groove. O-ring seals flanking the groove are set in radially outwardly open grooves of the base body and radially engage the inner face of spout sleeve to prevent leakage from between them. A valve cartridge carried on the base body varies flow from the inlet port or ports to the outlet port, either simply controlling flow rate from a single inlet port to the outlet port, or controlling the mix ratio and flow volume of water from hot- and cold-water inlet ports to the outlet port.

Thus with this faucet assembly water flows through the passage of the base body into the valve cartridge which outputs it to the groove, whence it flows up and out the spout. The spout can be pivoted about the base body without interrupting this flow.

The O-ring seals must inherently engage the spout sleeve with minimal force for proper sealing performance and maximum service life. Thus the spout can be pivoted very easily on the base body, especially when the O-rings are wet. In particular when the base body is of small diameter, the spout can pivot so easily that just normal vibration cased by water flow through it can swing it about its axis, especially when the faucet is not mounted perfectly vertical.

OBJECTS OF THE INVENTION

It is therefore an object of the present invention to provide an improved faucet with a pivotal spout.

Another object is the provision of such an improved faucet with a pivotal spout which overcomes the above-given disadvantages, that is which can pivot freely, but not so freely as to allow it to maladjust itself when this is not wanted.

SUMMARY OF THE INVENTION

A faucet assembly has according to the invention a stationary base body having an outer surface centered on an axis and formed with a passage having an outlet end opening at the outer surface. A spout sleeve fitted over the base body has an inner surface radially inwardly confronting the base-body outer surface. One of the surfaces is formed with a radially open groove centered on the axis, open toward the other surface, and into which the passage outlet end opens. A spout projecting radially from the sleeve has an outwardly open passage opening inward into the groove. Water is supplied under pressure to the base-body passage so that the water flows into the groove and thence through the spout passage and out of the spout. A radially expansible brake ring has an inner surface bearing radially inward against the base body and an outer surface bearing radially outward against the sleeve. According to the invention O-rings set in one of the surfaces engage the other surface and flank the groove and the brake ring is located outside the O-rings, that is not in the wet area between them.

Thus with this system the brake ring determines the resistance to pivoting of the spout on the base body. Mounting this brake ring in a dry area ensures that its braking effect will be unaffected by whether the faucet has been used recently or not, or whether it is outputing hot or cold water.

The outlet passage end is axially centered and opens axially. The faucet assembly further has according to the invention a pivot and connection tube mounted in the sleeve and having an inlet nipple fitted axially into the passage outer end and an outlet end opening into the groove. Thus this tube helps to center the spout on the base body while also conducting water from the base body to the spout.

According to the invention a spring presses the brake ring radially outward against the sleeve inner surface. The brake ring is split. The base body is formed with a radially outwardly open groove holding the spring and brake ring. This spring is an elastomeric annularly continuous ring engaged between the base body and the brake ring. The brake ring is made of a hard plastic, preferably of polyoximethylene.

More particularly in accordance with the invention the brake ring has a predetermined outside diameter, axial thickness, and radial thickness. The axial thickness are equal to between 0.04 and 0.1 times the diameter and the radial thickness are equal to between 0.01 and 0.09 times the diameter, preferably 0.048 times the diameter. In addition the brake ring has a rounded outer surface engaging the sleeve inner surface and having a radius of curvature equal to between 0.05 and 0.15 times the diameter, preferably 0.10 times the diameter.

BRIEF DESCRIPTION OF THE DRAWING

The above and other objects, features, and advantages will become more readily apparent from the following description, reference being made to the accompanying drawing in which:

FIG. 1 is a small-scale partly sectional side view of the faucet assembly according to the invention;

FIG. 2 is a large-scale view of a detail of FIG. 1; and

FIGS. 3 and 4 are side and top views of the brake ring used in accordance with the invention.

SPECIFIC DESCRIPTION

As seen in FIG. 1 a faucet assembly according to the invention has a base body 1 bolted to a counter 4 and having hot- and cold-water inlet pipes 11 (only one shown) extending down through a hole 40 in the counter 4. These inlet pipes 11 are connected through passages 16 in the body 1 to a standard valve cartridge 12 bolted to the top of the base body 1 and having a handle 13 pivotal about a horizontal axis to control the volume of flow from the pipes 11 to an outlet port 14 and about a vertical central axis A of the body 1 to control the mix of hot and cold water fed to the outlet 14.

A spout assembly 2 has a sleeve 20 engaged around the base body 1 and formed with a spout arm 21 extending generally radially of the axis A. This assembly 2 comprises an L-shaped polyoximethylene connection tube 22 having an axially centered inlet nipple 221 fitted in the outlet port 14 and sealed relative thereto by an O-ring 222 and an outlet opening radially outwardly into a groove 220 formed in the sleeve 20. This tube 22 rotates with the spout assembly 2 on the base body 1. O-rings 15 flanking the groove 220 engage outward against the sleeve 20 and inward against the body 1 to prevent leakage from therebetween. The inner end of the hollow spout 21 opens at 200 into the groove 220 and the outer end is provided with an aerator 210 of standard construction. Thus water entering via the pipes 11 is fed by the valve cartridge 12 to the outlet 14 whence it passes through the tube 22 to the groove 220 and then up the spout 21 and out the aerator 210. The sleeve 20 is lined with brass, and the base body 1 can be solid brass.

In accordance with the invention as shown in FIGS. 2 through 4, the base body 1 is formed axially below the lower seal ring 14 (or axially above it if desired) with a radially outwardly open rectangular-section groove 10 holding at its base an annularly elastomeric and continuous O-ring 31 and, radially outwardly thereof, a POM brake ring 3 formed with a split 30 and having an outside diameter 33, axial thickness 32, and radial thickness 36. Thus the O-ring 31 acts as a spring forcing the plastic brake ring 3 radially outward into engagement with the cylindrical and dry inner surface of the sleeve 20. The friction is exactly controllable so as to provide a predetermined light resistance to rotation of the sleeve 20 on the body 1 that, since it stays dry, does not change when the faucet is in use and that is largely unaffected by water pressure or temperature. It is, of course, within the scope of the invention to form the groove 10 in the sleeve 20 and have the ring 3 bear radially inward on the body 1.

According to the invention the axial thickness 32 is equal to between 0.04 and 0.1 times the diameter 33 and the radial thickness 36 is equal to between 0.01 and 0.9 times this outer diameter. An outer surface 35 of this brake ring 3 is rounded to a center of curvature 34 equal to between 0.05 and 0.15 times the diameter 33. These dimensions provide a braking effect that is sufficient to prevent the spout 21 from pivoting, even when water is gushing from the aerator 210, unless the user actually pivots it.

I claim:

1. A faucet assembly comprising:

a stationary base body having an outer surface centered on an axis and formed with a passage having an outlet end opening at the outer surface;

a spout sleeve fitted over the base body and having an inner surface radially inwardly confronting the base-body outer surface, one of the surfaces being formed with a radially open groove centered on the axis, open toward the other surface, and into which the passage outlet end opens;

a spout projecting radially from the sleeve and having an outwardly open passage opening inward into the groove;

means for supplying water under pressure to the base-body passage so that the water flows into the groove and thence through the spout passage and out of the spout;

a radially expansible brake ring having an inner surface bearing radially inward against the base body and an outer surface bearing radially outward against the sleeve; and spring means pressing the brake ring radially outward against the sleeve inner surface.

2. The faucet assembly defined in claim 1, further comprising:

O-rings set in one of the surfaces, engaging the other surface, and flanking the groove, the brake ring being located outside the O-rings.

3. The faucet assembly defined in claim 1 wherein the outlet passage end is axially centered and opens axially, the faucet assembly further comprising a connection tube mounted in the sleeve and having an inlet nipple fitted axially into the passage outer end and an outlet end opening into the groove.

4. The faucet assembly defined in claim 1 wherein the brake ring is split.

5. The faucet assembly defined in claim 4 wherein the base body is formed with a radially outwardly open groove holding the spring means and brake ring.

6. The faucet assembly defined in claim 1 wherein the spring means in an elastomeric annularly continuous ring engaged between the base body and the brake ring.

7. The faucet assembly defined in claim 1 wherein the brake ring is made of a hard plastic.

8. The faucet assembly defined in claim 7 wherein the brake ring is made of polyoximethylene.

9. The faucet assembly defined in claim 7 wherein the brake ring has a predetermined outside diameter, axial thickness, and radial thickness, the axial thickness being equal to between 0.04 and 0.1 times the diameter and the radial thickness being equal to between 0.01 and 0.09 times the diameter.

10. The faucet assembly defined in claim 9 wherein the radial thickness is 0.048 times the diameter.

11. The faucet assembly defined in claim 9 wherein the brake ring has a rounded outer surface engaging the sleeve inner surface and having a radius of curvature equal to between 0.05 and 0.15 times the diameter.

12. The faucet assembly defined in claim 11 wherein the radius is equal to 0.10 times the diameter.

13. The faucet assembly defined in claim 1 wherein the supply means includes a valve cartridge fixed to the base body.

* * * * *